US009242343B2

(12) United States Patent
Shi et al.

(10) Patent No.: US 9,242,343 B2
(45) Date of Patent: Jan. 26, 2016

(54) GRINDING WHEEL MACHINING DEVICE

(71) Applicants: HONG FU JIN PRECISION INDUSTRY (ShenZhen) CO., LTD., Shenzhen (CN); HON HAI PRECISION INDUSTRY CO., LTD., New Taipei (TW)

(72) Inventors: Tai-Ping Shi, Shenzhen (CN); Qi-Cai Ke, Shenzhen (CN)

(73) Assignees: HONG FU JIN PRECISION INDUSTRY (ShenZhen) CO., LTD., Shenzhen (CN); HON HAI PRECISION INDUSTRY CO., LTD., New Taipei (TW)

( * ) Notice: Subject to any disclaimer, the term of this patent is extended or adjusted under 35 U.S.C. 154(b) by 0 days.

(21) Appl. No.: 14/191,459

(22) Filed: Feb. 27, 2014

(65) Prior Publication Data

US 2014/0251298 A1 Sep. 11, 2014

(30) Foreign Application Priority Data

Mar. 11, 2013 (CN) ..... 2013 1 00761807

(51) Int. Cl.
*B24B 53/12* (2006.01)
*B24B 53/08* (2006.01)

(52) U.S. Cl.
CPC ..... *B24B 53/08* (2013.01)

(58) Field of Classification Search
CPC ..... B24B 53/08; B24B 53/017; B24B 53/12; B24B 53/00
USPC ..... 125/11.01, 11.02, 11.15, 11.18; 451/443
See application file for complete search history.

(56) References Cited

U.S. PATENT DOCUMENTS 1,464,344 A * 8/1923 Strong ..... 125/11.01
2,855,917 A * 10/1958 Berg ..... 125/11.15
3,532,084 A * 10/1970 Swenson ..... 125/11.01

FOREIGN PATENT DOCUMENTS

TW M406489 7/2011

* cited by examiner

*Primary Examiner* — Robert Rose
(74) *Attorney, Agent, or Firm* — Novak Druce Connolly Bove + Quigg LLP

(57) ABSTRACT

A grinding wheel machining device includes a movable platform and a grinding wheel machining mechanism. The grinding wheel machining mechanism includes a mounting assembly, a tool holder mounted on the movable member, a machining tool mounted on the tool holder, and an adjusting assembly. The mounting assembly includes a fixing base mounted on the movable platform, a movable member mounted onto the fixing base, and a rotation shaft received into the fixing base and the movable member. The machining tool includes a cutting edge. The adjusting assembly includes a reference member and an adjusting member. The reference member is fixed on the movable member and includes a reference surface. The reference surface is coplanar with a central axis of the rotation shaft. The adjusting member is received into the tool holder and threaded into the reference surface.

18 Claims, 4 Drawing Sheets

GRINDING WHEEL MACHINING DEVICE

FIELD

The present disclosure relates to machining devices, and particularly to a machining device for machining a grinding wheel.

BACKGROUND

In a process of machining a grinding wheel, a grinding wheel machining device machines sidewalls of the grinding wheel. However, a thickness of the grinding wheel is manually measured by a measuring tool, which is inefficient. Furthermore, the grinding wheel and/or the grinding wheel machining device may need to be manually adjusted many times, which may result in deviations of positions of the grinding wheel relative to the machining tool.

Therefore, there is room for improvement in the art.

BRIEF DESCRIPTION OF THE DRAWINGS

The components in the drawings are not necessarily drawn to scale, the emphasis instead being placed upon clearly illustrating the principles of the present disclosure. Moreover, in the drawings, like reference numerals designate corresponding parts throughout several views.

DETAILED DESCRIPTION

The disclosure is illustrated by way of example and not by way of limitation in the figures of the accompanying drawings in which like references indicate similar elements. It should be noted that references to "an" or "one" embodiment in this disclosure are not necessarily to the same embodiment, and such references mean "at least one."

Figure 1:
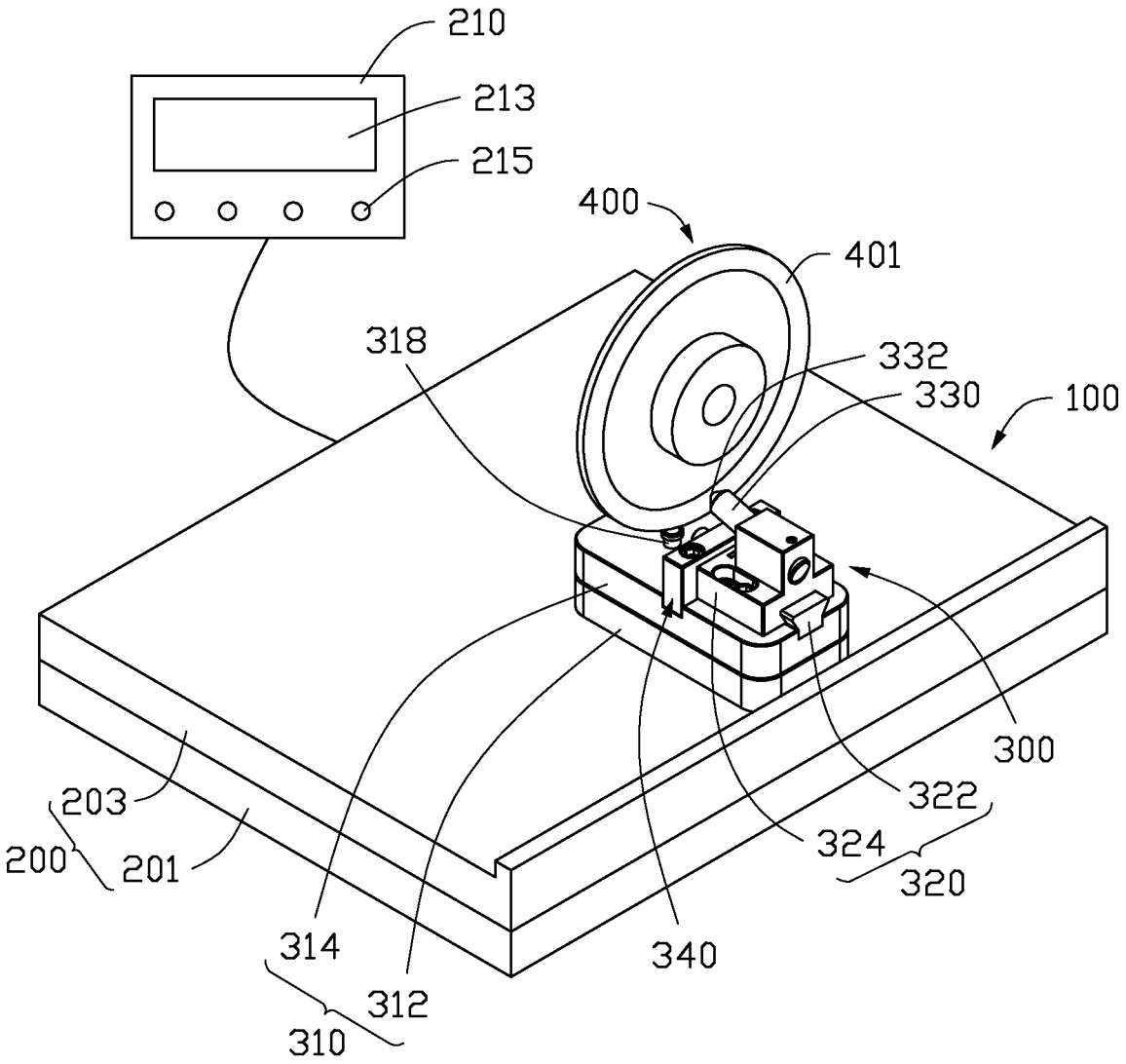
FIG. 1 is an isometric view of an embodiment of a machining device in a first state of use, the machining device including a grinding wheel machining mechanism.
Figure 2:
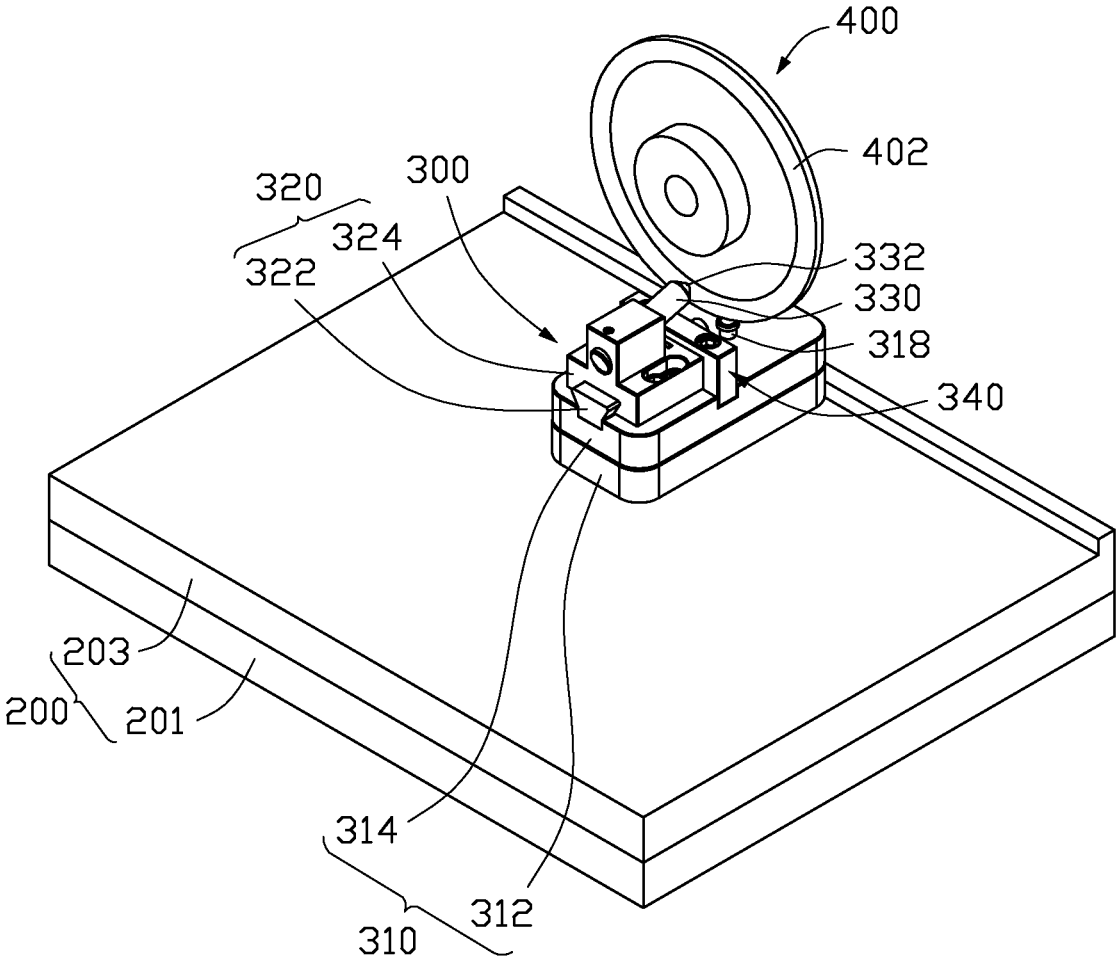
FIG. 2 is an isometric view of the machining device of FIG. 1 in a second state of use.

FIGS. 1 and 2 show an embodiment of a grinding wheel machining device 100 for machining a grinding wheel 400. The grinding wheel machining device 100 includes a controlling platform 200, a controller 210, and a grinding wheel machining mechanism 300. The controlling platform 200 is configured for supporting the grinding wheel machining mechanism 300. The controller 210 controls the controlling platform 200 to move, thereby moving the grinding wheel machining mechanism 300.

The controlling platform 200 includes a fixing platform 201 and a movable platform 203. In the illustrated embodiment, the fixing platform 201 and the movable platform 203 are substantially cuboid. The fixing platform 201 is configured to be fixed on a ground or a worktable (not shown) when in use. The movable platform 203 is movably mounted on the fixing platform 201, and configured to support the grinding wheel machining mechanism 300. When the movable platform 203 moves relative to the fixing platform 201, the grinding wheel machining device 300 moves along with the movable platform 203.

The controller 210 is electrically connected to the movable platform 203 and configured to control the movable platform 203 to move relative to the fixing platform 201. The controller 210 includes a display screen 213 and an operation portion 215. The display screen 213 displays coordinates of positions of the movable platform 203. The operation portion 215 is used to change parameters of the coordinates of positions. Thus, the controller 210 controls the movable platform 203 to move according to the changed coordinates of positions of the movable platform 203.

Figure 3:
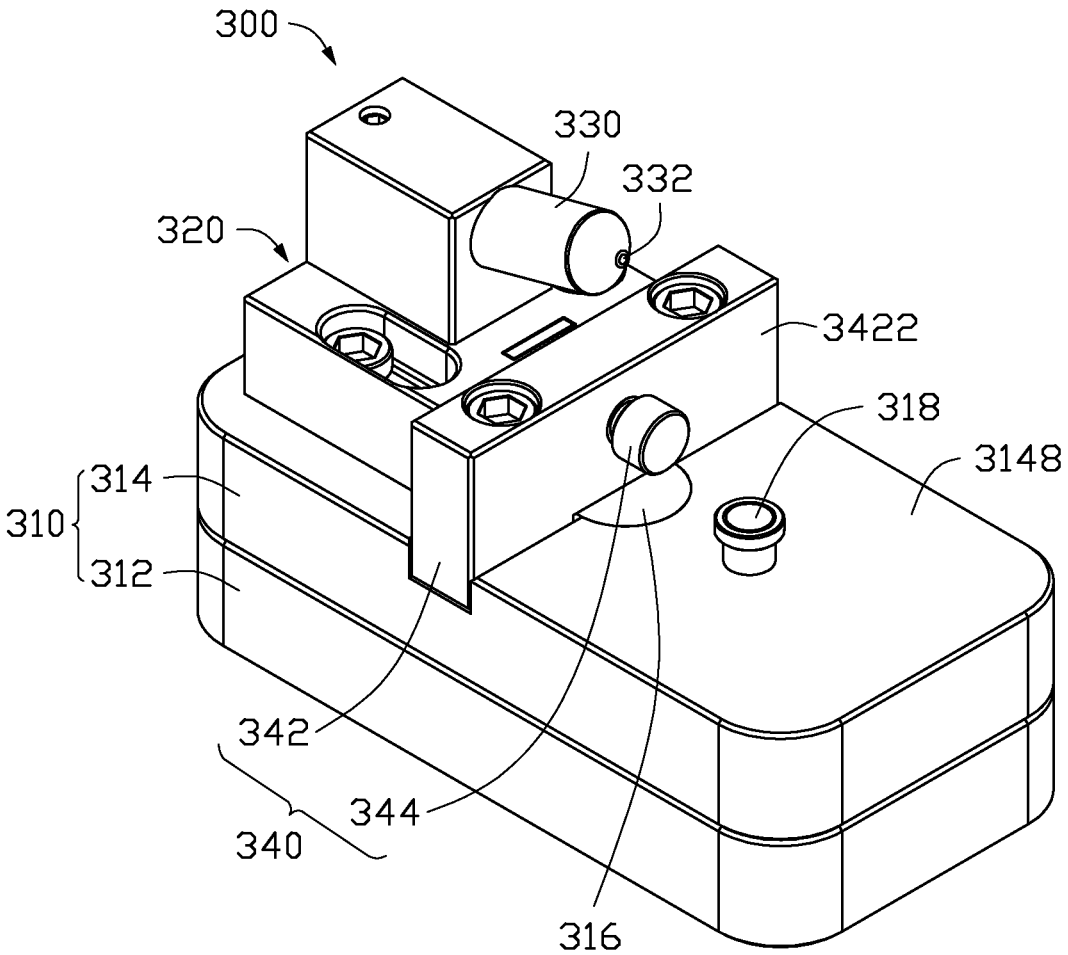
FIG. 3 is an isometric view of the grinding wheel machining mechanism of the grinding wheel machining device of FIG. 1.

FIG. 3 shows the grinding wheel machining mechanism 300 including a mounting assembly 310, a tool holder 320, a machining tool 330, and an adjusting assembly 340. The mounting assembly 310 is mounted on the movable platform 203. The tool holder 320 is located on the mounting assembly 310. The machining tool 330 is mounted on the tool holder 320. The adjusting assembly 340 is located on the mounting assembly 310 and connected to the tool holder 320, for adjusting a position of the machining tool 330.

Figure 4:
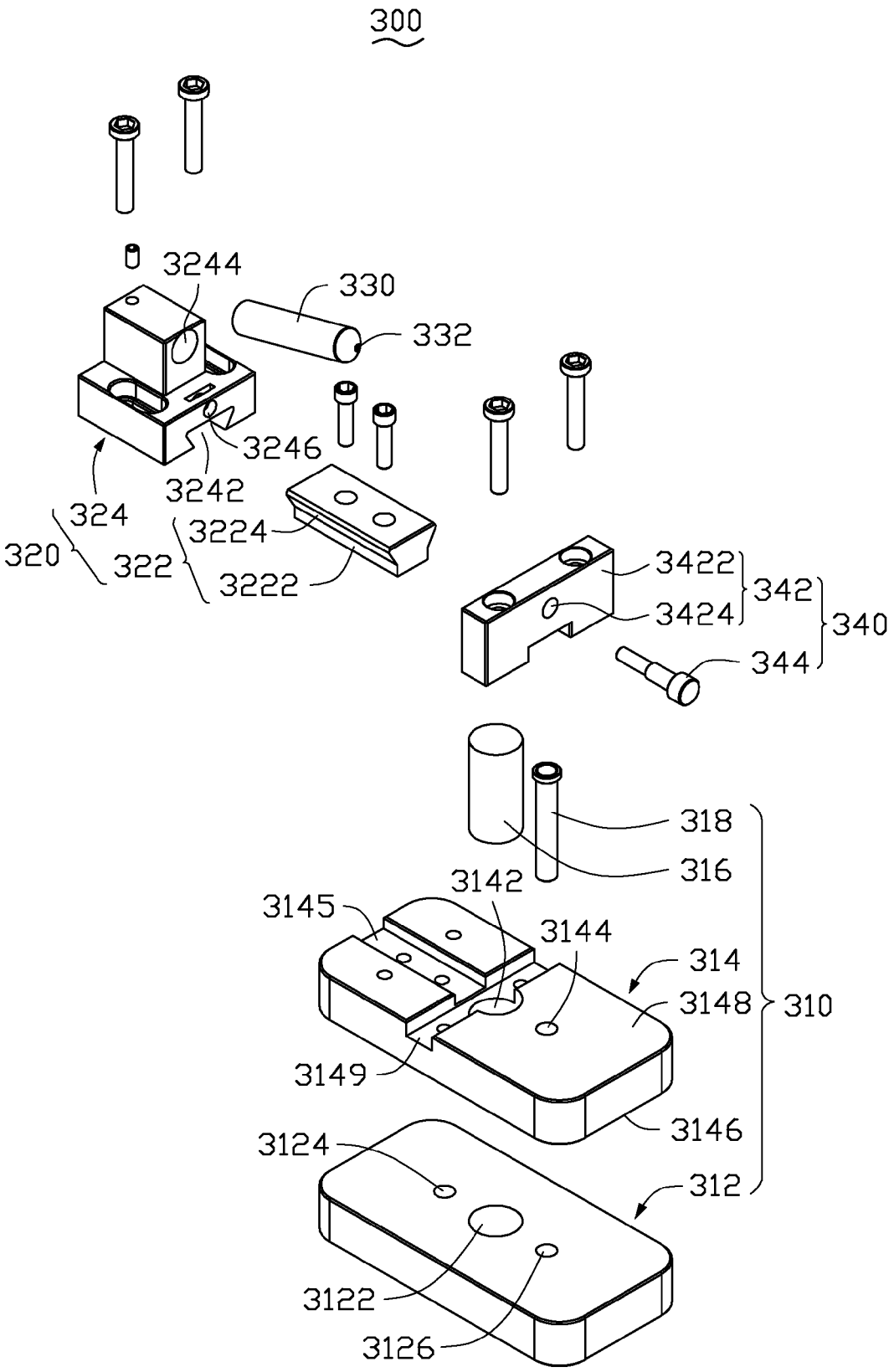
FIG. 4 is an exploded, isometric view of the grinding wheel machining mechanism of the grinding wheel machining device of FIG. 3.

FIG. 4 shows that the mounting assembly 310 includes a fixing base 312, a movable member 314, a rotation shaft 316, and a positioning member 318. The fixing base 312 is fixedly mounted on the movable platform 203 and mounted to the movable member 314, respectively. Both the fixing base 312 and the movable member 314 are sleeved around the rotation shaft 316. The positioning member 318 restricts movement of the movable member 314 relative to the fixing base 312.

In one embodiment, the fixing base 312 is substantially cuboid and defines a first through hole 3122 in a substantially central portion thereof for partially receiving the rotation shaft 316. The fixing base 312 further defines a first positioning hole 3124 and a second positioning hole 3126 at opposite sides of the first through hole 3122 for alternately receiving a part of the positioning member 318. The first positioning hole 3124 and the second positioning hole 3126 are symmetrically arranged about the first through hole 3122. In the illustrated embodiment, the first positioning hole 3124 and the second positioning hole 3126 are through holes.

In one embodiment, the movable member 314 is substantially cuboid and located above the fixing base 312. The movable member 314 defines a second through hole 3142 in a substantially central portion thereof spatially corresponding to the first through hole 3122 of the fixing base 312. The second through hole 3142 is aligned with the first through hole 3122 and configured to partially receive the rotation shaft 316. The movable member 314 further defines a locking hole 3144 adjacent to the second through hole 3142. The locking hole 3144 is alternately aligned with the first positioning hole 3124 and the second positioning hole 3126 for partially receiving the positioning member 318. In the illustrated embodiment, the locking hole 3144 is a through hole. A distance between the locking hole 3144 and the second through hole 3142 is substantially equal to a distance between the first positioning hole 3124 and the first through hole 3122.

The movable member 314 includes a bottom surface 3146 and a top surface 3148 substantially parallel to the bottom surface 3146. Both the second through hole 3142 and the locking hole 3144 pass through the bottom surface 3146 and the top surface 3148, respectively. The top surface 3148 of the movable member 314 is configured to support the tool holder 320 and the adjusting assembly 340. The top surface 3148 defines a fixing groove 3145 and a mounting groove 3149 substantially perpendicular to the fixing groove 3145. The fixing groove 3145 is located at a side of the second through hole 3142 away from the locking hole 3144, and extends toward the second through hole 3142. The mounting groove 3149 communicates with the second through hole 3142 and the fixing groove 3145.

The rotation shaft 316 is substantially a rod. A first end portion of the rotation shaft 316 is received in the first through hole 3122 of the fixing base 312, and a second end portion of the rotation shaft 316 is received in the second through hole 3142 of the movable member 314. Thus, the movable member 314 is rotatable around the rotation shaft 316. The positioning member 318 is movably received into the locking hole 3144 and into either the first positioning hole 3124 or the second positioning hole 3126, for positioning the movable member 314 relative to the fixing base 312. In the illustrated embodiment, the positioning member 318 is a pin. In an alternative embodiment, the positioning member 318 can be another positioning structure, such as a latching structure, such that the locking hole 3144, the first positioning hole 3124, and the second positioning hole 3126 are replaced with corresponding latching structures.

The tool holder 320 is movably mounted on the top surface 3148 of the movable member 314. The tool holder 320 includes a guiding member 322 and a base 324. The base 324 is movably mounted on the guiding member 322. In one embodiment, the guiding member 322 is substantially cuboid.

The guiding member 322 includes a mounting portion 3222 and a guiding portion 3224 formed on the mounting portion 3222. The mounting portion 3222 is received in the fixing groove 3145 of the movable member 314. The guiding portion 3224 protrudes from the top surface 3148 of the movable member 314.

The base 324 of the tool holder 320 defines a sliding groove 3242 and a first adjusting hole 3246 adjacent to the sliding groove 3242. The guiding portion 3224 is slidably received in the sliding groove 3242, thus enabling the base 324 to slide along the guiding portion 3224 of the guiding member 322. The base 324 further defines a receiving hole 3244 for receiving the machining tool 330. A plane defined by a central axis of the receiving hole 3244 and a central axis of the rotation shaft 316 is substantially perpendicular to the top surface 3148 of the movable member 314.

The machining tool 330 includes a cutting edge 332 at a distal end thereof. An end of the machining tool 330 located away from the cutting edge 332 thereof is fixedly received in the receiving hole 3244 of the base 324. The cutting edge 332 of the machining tool 330 protrudes from the receiving hole 3244.

The adjusting assembly 340 is mounted on the top surface 3148 of the movable member 314 and connected to the tool holder 320, for adjusting the machining tool 330. The adjusting assembly 340 includes a reference member 342 and an adjusting member 344. The reference member 342 is fixedly received in the mounting groove 3149, and includes a reference surface 3422. The reference surface 3422 of the reference member 342 defines a second adjusting hole 3424 aligned with the first adjusting hole 3246 of the base 324. The adjusting member 344 extends through the second adjusting hole 3424. A first end portion of the adjusting member 344 is fixedly received in the second adjusting hole 3424, and a second end portion of the adjusting member 344 is threaded into the first adjusting hole 3246. When the adjusting member 344 is rotated, the base 324 is driven to slide along the guiding portion 3224 of the guiding member 322 along a direction substantially perpendicular to the reference surface 3422 of the reference member 342. In an alternative embodiment, the adjusting member 344 is threaded into the second adjusting hole 3424, and a distal end thereof is received in the first adjusting hole 3246.

In assembly, first, the movable platform 203 assembled onto the fixing platform 201. Second, the fixing base 312 is fixed on the movable platform 203, and the movable member 314 is mounted onto the fixing base 312. The rotation shaft 316 is received into the first through hole 3122 and the second through hole 3142. The positioning member 318 is received into the locking hole 3144 and into either the first positioning hole 3124 or the second positioning hole 3126 corresponding to the locking hole 3144. Third, the mounting portion 3222 of the guiding member 322 is received into the fixing groove 3145, and a surface of the base 324 defining the first adjusting hole 3246 faces toward the rotation shaft 316. Fourth, the reference member 342 is movably received into the mounting groove 3149 of the movable member 314. The adjusting member 344 extends through the second adjusting hole 3424 and is threaded into the first adjusting hole 3246. The machining tool 330 is received into the receiving hole 3244 of the base 324, such that the cutting edge 332 of the machining tool 330 protrudes from the base 324.

FIG. 1 shows a first state of use for the grinding wheel machining device 100. The positioning member 318 is received into the locking hole 3144 and the first positioning hole 3124. The adjusting member 344 is rotated, thus driving the base 324 and the machining tool 330 to move along the guiding member 322, until the cutting edge 332 of the machining tool 330 is coplanar with the reference surface 3422 of the reference member 342. Because the fixing groove 3145 extends along a diameter of the second through hole 3142, and the receiving hole 3244 is located right above the sliding groove 3242, the cutting edge 332 can be aligned with a center of the second through hole 3142 and the central axis of the rotation shaft 316. The grinding wheel 400, which needs to be machined, is positioned by a clamping device (not shown). The grinding wheel 400 includes a first sidewall 401 and a second sidewall 402 substantially parallel to the first sidewall 401. The cutting edge 332 of the machining tool 330 resists against the first sidewall 401 of the grinding wheel 400, thus machining the first sidewall 401.

FIG. 2 shows a second state of use for the grinding wheel machining device 100. After the first sidewall 401 of the grinding wheel 400 is machined, the controller 210 obtains a coordinate of a position of the movable platform 203. Then, the controller 210 controls the movable platform 203 to move away from the grinding wheel 400 at a determined distance. The positioning member 318 is removed from the locking hole 3144 and the first positioning hole 3124 to unlock the movable member 314 from the fixing base 312. The movable member 314 is rotated 180 degrees relative to the fixing base 312, and the positioning member 318 is received into the locking hole 3144 and the second positioning hole 3126 to lock the fixing base 312 and the movable member 314 together. Then, the controller 210 controls the movable platform 203 to move until the second sidewall 402 of the grinding wheel 400 resists the cutting edge 332 of the machining tool 330. The controller 210 controls the movable platform 203 to move the machining tool 330 a predetermined distance along a thickness direction of the grinding wheel 400, according to a needed or desired thickness of the grinding wheel 400 and the coordinates of the movable platform 203, and the cutting edge 332 of the machining tool 330 machines the second sidewall 402 of the grinding wheel 400. Therefore, the grinding wheel 400 is precisely machined by the machining tool 330.

In an alternative embodiment, the fixing platform 201 can be omitted, such that the movable platform 203 is movably mounted on a floor or a worktable. The fixing groove 3145 and the mounting groove 3149 of the movable member 314 can be omitted, such that the tool holder 320 and the adjusting assembly 340 are directly assembled on the movable member 314. The guiding member 322 of the tool holder 320 can be omitted, such that the base 324 of the tool holder 320 is directly mounted onto the movable member 314.

It is believed that the present embodiments and their advantages will be understood from the foregoing description, and it will be apparent that various changes may be made thereto without departing from the spirit and scope of the embodiments or sacrificing all of its material advantages.

What is claimed is:

1. A grinding wheel machining device, comprising:

a controlling platform comprising a movable platform;

a controller electrically connected to the movable platform, and capable of controlling the movable platform to move; and a grinding wheel machining mechanism, comprising:

a mounting assembly comprising a fixing base mounted on the movable platform, a movable member, and a rotation shaft, the fixing base and the movable member movably connected to each other by the rotation shaft, the movable member capable of rotating around the rotation shaft relative to the fixing base;

a tool holder mounted on the movable member;

a machining tool mounted on the tool holder, and comprising a cutting edge, and an adjusting assembly comprising a reference member and an adjusting member, the reference member fixed on the movable member, and comprising a reference surface, the reference surface coplanar with a central axis of the rotation shaft, the adjusting member connected to the tool holder and the reference member, and capable of adjusting the tool holder to move towards the reference member, thereby aligning the cutting edge of the machining tool to the central axis of the rotation shaft.

2. The grinding wheel machining device of claim 1, wherein the controller comprises a display screen and an operation portion, the display screen is capable of displaying a coordinate of a position of the movable platform, the operation portion is capable of controlling the movable platform to move.

3. The grinding wheel machining device of claim 1, wherein the tool holder comprises a guiding member, the guiding member comprises a mounting portion and a guiding portion formed on the mounting portion, the mounting portion is located on the movable member, the guiding portion protrudes from the movable member, and is perpendicular to the reference surface.

4. The grinding wheel machining device of claim 3, wherein the tool holder further comprises a base, the base defines a sliding groove at a side thereof away from the machining tool, the guiding portion is slidably received in the sliding groove, so that the base is movably sleeved on the guiding portion, the base is capable of sliding along the guiding portion, to move the machining tool towards the reference member.

5. The grinding wheel machining device of claim 4, wherein the base further defines a receiving hole at a surface thereof adjacent to the reference surface, the machining tool is received in the receiving hole, a plane defined by the cutting edge of the machining tool and the central axis of the rotation shaft is perpendicular to the reference surface.

6. The grinding wheel machining device of claim 1, wherein the tool holder defines a first adjusting hole at a side thereof adjacent to the reference member, the reference member defines a second adjusting hole aligned to the first adjusting hole, the adjusting member is received into the second adjusting hole, and threaded into the first adjusting hole.

7. The grinding wheel machining device of claim 1, wherein the fixing base defines a first through hole, the movable member defines a second through hole corresponding to the first through hole of the fixing base, the fixing base is mounted on the movable member, and the rotation shaft is received into the first through hole and the second through hole.

8. The grinding wheel machining device of claim 7, wherein the movable member defines a mounting groove at a surface thereof away from the fixing base, the reference member is fixedly received in the mounting groove.

9. The grinding wheel machining device of claim 7, wherein the movable member further defines a fixing groove at a surface thereof away from the fixing base, the fixing groove is perpendicular to the reference surface, and extends to the second through hole, the tool holder is received in the fixing groove.

10. The grinding wheel machining device of claim 7, wherein the fixing base further defines a first positioning hole and a second positioning hole, the first positioning hole and the second positioning hole are symmetrically arranged about the first through hole, the movable member defines a locking hole, a distance between the locking hole and the second through hole is substantially equal to a distance between the first positioning hole and the first through hole, the mounting assembly further comprises a positioning member, the positioning member is detachably received into the locking hole, and is alternately received into the first positioning hole and the second positioning hole.

11. A grinding wheel machining device, comprising:

a movable platform;

a grinding wheel machining mechanism, comprising:

a mounting assembly comprising a fixing base mounted on the movable platform, a movable member mounted on the fixing base, and a rotation shaft received into the fixing base and the movable member, the movable member capable of rotating around the rotation shaft relative to the fixing base, a tool holder mounted on the movable member and the tool holder comprising a guiding member, the guiding member having a mounting portion fixed on the movable member and a guiding portion formed on the mounting portion, a machining tool mounted on the tool holder, and comprising a cutting edge, and an adjusting assembly comprising a reference member and an adjusting member, the reference member located on the movable member, and comprising a reference surface, the reference surface coplanar with a central axis of the rotation shaft, the adjusting member received into the reference member, and threaded into the tool holder, the guiding portion protruding from the movable member, and substantially perpendicular to the reference surface.

12. The grinding wheel machining device of claim 11, wherein the tool holder further comprises a base, the base defines a sliding groove at a side thereof away from the machining tool, the guiding portion is slidably received in the sliding groove, so that the base is movably sleeved on the guiding portion, the base is capable of sliding along the guiding portion in a direction perpendicular to the reference surface, to move the machining tool towards the reference member.

13. The grinding wheel machining device of claim 12, wherein the base further defines a receiving hole at a surface thereof adjacent to the reference surface, the machining tool is received in the receiving hole, a plane defined by the cutting edge of the machining tool and the central axis of the rotation shaft is perpendicular to the reference surface.

14. The grinding wheel machining device of claim 11, wherein the tool holder defines a first adjusting hole at a side thereof adjacent to the reference member, the reference member defines a second adjusting hole aligned to the first adjusting hole, the adjusting member is received into the second adjusting hole, and threaded into the first adjusting hole.

15. The grinding wheel machining device of claim 11, wherein the fixing base defines a first through hole, the movable member defines a second through hole corresponding to the first through hole, the rotation shaft is received into the first through hole and the second through hole.

16. The grinding wheel machining device of claim 15, wherein the movable member defines a mounting groove, the reference member is fixed received in the mounting groove, and the reference surface resists the movable member.

17. The grinding wheel machining device of claim 15, wherein the movable member further defines a fixing groove, the fixing groove is perpendicular to the reference surface, and extends to the second through hole, the tool holder is received in the fixing groove.

18. The grinding wheel machining device of claim 15, wherein the fixing base further defines a first positioning hole and a second positioning hole, the first positioning hole and the second positioning hole are symmetrical about the first through hole, the movable member defines a locking hole, a distance between the locking hole and the second through hole is substantially equal to a distance between the first positioning hole and the first through hole, the mounting assembly further comprises a positioning member, the positioning member is detachably received into the locking hole, and is alternatively received into the first positioning hole and the second positioning hole.

* * * * *